US005459965A

United States Patent [19]

Meckstroth

[11] Patent Number: 5,459,965

[45] **Date of Patent: * Oct. 24, 1995**

[54] LEAF DEFLECTING COVER DEVICE FOR A RAIN GUTTER

[76] Inventor: Alan F. Meckstroth, 2310 Far Hills Bldg., Dayton, Ohio 45419

[ * ] Notice: The portion of the term of this patent subsequent to Jan. 26, 2010 has been disclaimed.

[21] Appl. No.: 364,770

[22] Filed: Dec. 27, 1994

Related U.S. Application Data

[63] Continuation of Ser. No. 162,447, Dec. 3, 1993, Pat. No. 5,375,379, which is a continuation-in-part of Ser. No. 7,267, Jan. 21, 1993, abandoned, which is a continuation-in-part of Ser. No. 811,863, Dec. 23, 1991, Pat. No. 5,181,350.

[51] Int. Cl.[6] ..... E04D 13/00

[52] U.S. Cl. ..... 52/12; 52/11; 248/48.1; 210/474

[58] Field of Search ..... 52/12, 11; 248/48.1; 210/474

[56] References Cited

U.S. PATENT DOCUMENTS

| | | | |
|---|---|---|---|
| 4,404,775 | 9/1983 | Demartini | 52/12 |
| 4,435,925 | 3/1984 | Jefferys | 52/12 |
| 4,592,174 | 6/1986 | Hileman | 52/12 |
| 4,796,390 | 1/1989 | Demarhni | 52/12 |
| 4,937,986 | 7/1990 | Way, Sr. et al. | 52/12 |
| 5,010,696 | 4/1991 | Knilfel | 52/12 |
| 5,170,597 | 12/1992 | Steariss | 52/58 |
| 5,181,350 | 1/1993 | Meckstroth | 52/12 |
| 5,375,379 | 12/1994 | Meckstroth | 52/12 |

FOREIGN PATENT DOCUMENTS

| | | | |
|---|---|---|---|
| 0563208 | 9/1958 | Canada | 52/12 |

*Primary Examiner*—Michael Safavi
*Assistant Examiner*—Robert J. Canfield
*Attorney, Agent, or Firm*—Jacox & Meckstroth

[57] ABSTRACT

An elongated strip of extruded plastics material includes a generally flat longitudinally extending inner portion adapted to project under the shingles of a roof and a longitudinally extending outer portion adapted to seat on the outer edge portion of a rain gutter and project outwardly from the gutter to form a drip lip spaced from the gutter. A longitudinally extending intermediate portion of the strip integrally connects the inner portion to the outer portion and has a rounded nose surface above a U-shaped channel portion having longitudinally spaced slots for directing water from the inner portion into the gutter and for deflecting leaves and other debris onto the outer portion of the strip for dropping from the drip lip. A tab or flange projects outwardly from the U-shaped portion and cooperates with the outer portion to define a channel for receiving the outer edge portion of the gutter and to provide for retaining the strip on the gutter and for pivoting the strip relative to the gutter. In one embodiment, the flange has a double wall thickness, and in another modification, retaining tabs are formed by separate clips which overlap the outer portions of adjacent cover sections and project through the slots.

6 Claims, 2 Drawing Sheets

LEAF DEFLECTING COVER DEVICE FOR A RAIN GUTTER

RELATED APPLICATIONS

This is application is a continuation of application Ser. No. 08/162,447, filed Dec. 3, 1993, U.S. Pat. No. 5,375,379, which is a continuation-in-part of application Ser. No. 08/007,267, filed Jan. 21, 1993, abandoned, which is a continuation-in-part of application Ser. No. 811,863, filed Dec. 23, 1991, U.S. Pat. No. 5,181,350.

BACKGROUND OF THE INVENTION

In the installation of rain gutters on a residential building, it is common to roll-form longitudinal sections of the gutter at the site of the building with each section corresponding to the length of an eave portion of the roof. This roll-forming minimizes the number of joints in the gutter and provides an attractive continuous appearance along the eave. Usually, the gutters are roll-formed from prefinisher or prepainted aluminum strip which is fed from a supply coil having a width corresponding to the periphery of the gutter. The continuous gutter is usually installed with longitudinally spaced brackets or aluminum anchor nails. The nails pierce holes within the outer and inner edge portions of the gutter and extend through spacer tubes into the vertical board and the ends of the supporting rafters.

There have been many different types of perforated screens and nonperforated or impervious cover devices which are designed to cover ether all or a large portion of the gutters to avoid collecting within the gullets leaves, sticks, bark and other debris which are carried down the roof by rain water. For example, U.S. Pat. Nos. 2,672,832, 4,435,925, 4,455,791, 4,796,390 and 4,866,890 disclose various forms of solid or impervious gutter cover members. The members are mounted above the gutters and project under the roof covering or shingles for directing water flowing from the shingles into the gullet and for deflecting leaves and other debris onto the outer edge or return flange portion of the gutter. For example, the gutter cover disclosed in connection with FIG. 7 of U.S. Pat. No. 4,455,791 is formed of sheet metal or aluminum and has a longitudinally extending rolled or curled outer edge portion. The edge portion is spaced inwardly and above the outer edge portion or return flange portion of the gutter by a series of longitudinally spaced sheet metal brackets. The brackets grip the curled outer edge portion of the gutter cover and also grip the top return flange or the outer edge portion of the gutter to form a gap between the opposing edge portions. Water flowing across the gutter cover is directed partially around the rounded edge portion of the gutter by surface adhesion and falls downwardly through the gap into the gutter.

One objection to impervious-type gutter covers as disclosed in the above-mentioned patents, is that leaves, small sticks, small pieces of bark and other debris which are directed from the gutter cover onto the outer edge portion of the gutter, flow downwardly along the outer exposed surface of the gutter and drop from the bottom wall of the gutter. As a result, dirt collects on the outer exposed surface of the gutter and results in a gutter having an undesirable dirty appearance after a period of use, especially when the gutter is roll-formed from white finished aluminum strip. In addition, it has been found that the longitudinally spaced brackets which mount on the outer return flange portion of the gutter to support and space the curled outer edge portion of the cover, are awkward to install and sometimes shift inwardly or drop off after being installed for a period of time so that the outer edge portion of the cover is not properly spaced from the outer edge portion of the gutter. Also, the outer edge portion of the gutter is usually not perfectly straight so that the gap varies along the length of the gutter and may be too wide or too narrow.

SUMMARY OF THE INVENTION

The present invention is directed to an improved rain gutter cover device which may be quickly and conveniently installed on a rain gutter and which provides for directing rain water into the gutter and for deflecting leaves, sticks, bark and other debris over the gutter and onto the ground without touching the rain gutter. As a result, the leaves and other debris are not carried by rain water down the outer surface of the gutter, and the outer surface of the gutter remains clean and unstained. The gutter cover of the invention also accommodates roofs having different pitches and adjusts to the gradual slope of the gutter relative to the edge of the roof.

In accordance with one embodiment of the invention, a continuous gutter cover is formed by a series of elongated cover sections arranged in abutting end-to-end relation with each section cut from a strip extruded from a semi-rigid plastics material. Each cover section has a longitudinally extending and generally flat inner portion adapted to project under the roof covering or shingles and a longitudinally extending outer portion adapted to seat on the outer edge portion or return flange portion of the gutter. The outer portion of each cover section projects outwardly from the gutter and forms a drip lip spaced from the gutter.

The outer and inner portions of each cover section are integrally connected by a longitudinally extending intermediate portion which includes a downwardly curved or rounded nose portion projecting above a U-shaped channel portion. The channel portion has longitudinally spaced slots which direct the water flowing down the inner portion of the cover section and around the nose portion into the gutter. A longitudinally extending tab or flange projects outwardly from the channel portion and cooperates with the outer portion to define a channel for receiving and hooking the outer edge portion of the gutter. The flange also cooperates with the outer portion of the cover section so that the cover section may be pivoted relative to the gutter for accommodating roofs having different slopes and for accommodating the slope or grade of the gutter. In modifications, the gutter cover is formed from a flat extrusion or strip with the retaining flange or tab having a folded double wall thickness or formed by separate clips which project through the slots and overlap the outer portions of adjacent cover strips.

Other features and advantages of the invent ion will be apparent from the following description, the accompanying drawing and the appended claims.

DESCRIPTION OF THE PREFERRED EMBODIMENTS

Figure 1:
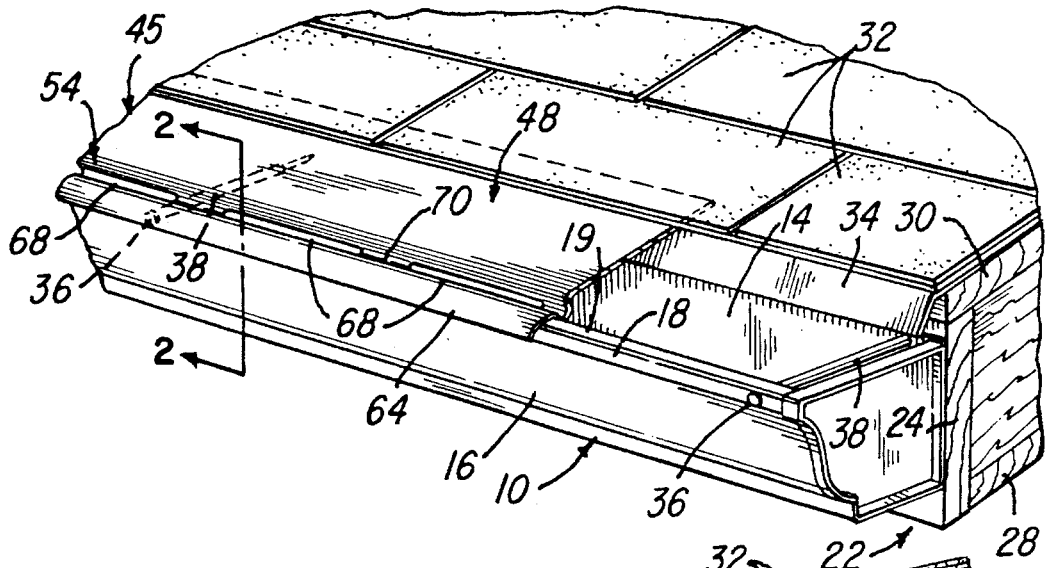
FIG. 1 is a perspective view of a gutter cover constructed in accordance with the invention and shown installed on a gutter mounted on a roof eave.
Figure 2:
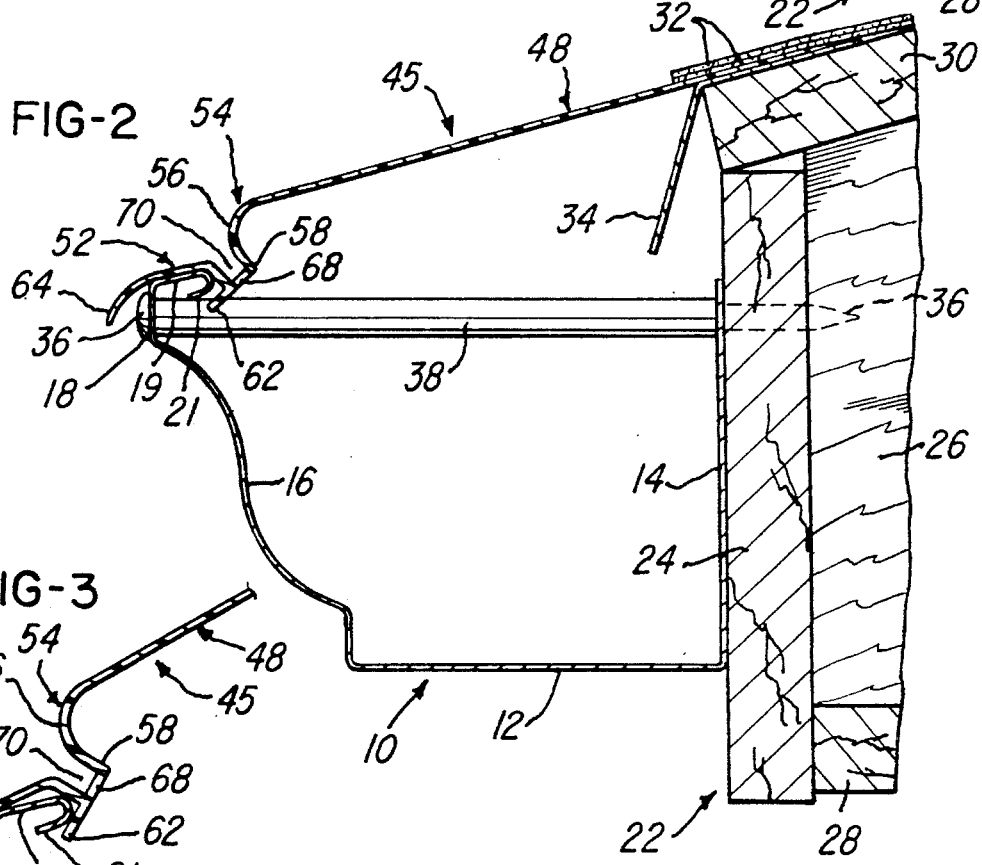
FIG. 2 is a vertical section taken generally on the line 2—2 of FIG. 1 and shown at a scale of about 70% of full scale.

FIG. 1 illustrates a portion of a conventional continuous-type rain gutter 10 which is roll-formed from an aluminum strip having an outer surface prefinished with a baked enamel coating which may be white or any other desired color. As shown in the cross-section of FIG. 2, the rain gutter 10 includes a flat horizontal bottom wall 12 which integrally connects a flat vertical rear wall 14 to a curved or contoured front wall 16. The front wall 16 has an outer edge or channel portion 18 which includes a return flange 19 terminating with a reverse tab 21. The rain gutter 10 is shown in FIG. 2 installed on a typical eave 22 of a residential building. The eave 22 includes a wood fascia board 24 which is nailed to the ends of a series of spaced rafters 26 and which extends from a horizontal soffit board 28 to a sloping roof sheeting or board 30. The sheeting 30 is usually covered by a layer of felt (not shown) and a roof covering such as overlapping asphalt shingles 32. An angularly formed sheet metal drip strip 34 is commonly installed on the roof sheeting 30 under the shingles 32 for directing water draining from the shingles into the rain gutter 10.

In a conventional manner, the rain gutter 10 is attached or secured to the fascia board 24 by a series of longitudinally spaced mounting brackets (not shown) or aluminum nails 36 which extend through holes formed within the front wall 18 and the rear wall 14 of the gutter. The nails 36 also extend through corresponding sheet metal or plastic spacer ferrules or tubes 38 which maintain the front wall 16 of the gutter 10 in fixed spaced relation to the rear wall 14 of the gutter. While a conventional continuous-type roll-formed sheet metal rain gutter 10 is illustrated in the drawing along with conventional mounting nails 36 and spacer tubes 38, the cover strip of the invention may be used or adapted for use with other forms and shapes of rain gutters and mounting means.

In accordance with the present invention, a gutter cover is formed by a series of elongated sections or strips 45 each cut from an extrusion of a semi-rigid plastics material such as polyvinyl chloride or polypropylene. Each cover section or strip 45 includes a generally flat inner portion 48 having a generally uniform wall thickness of about 0.030 inch to 0.040 inch, and the inner portion 48 is adapted to slide under the roof covering or shingles 32. Each cover strip 45 may have any desired length, but preferably has a length from four feet to six feet to facilitate packaging and shipping of a series of strips in a bundle and also to provide for conveniently installing each strip while standing on a ladder.

Figure 3:
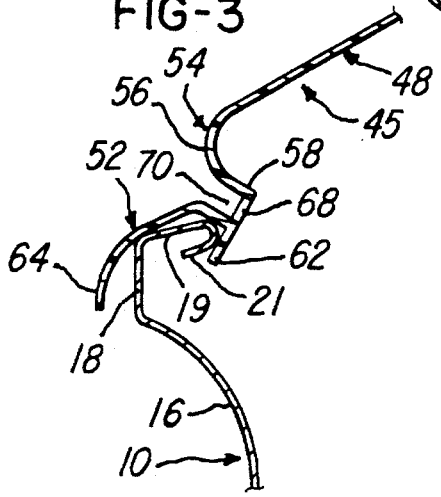
FIG. 3 is a fragmentary section and showing at full scale the gutter cover pivoted to a more inclined angle relative to the gutter.

Each cover strip 45 also includes an outer portion 52 which is integrally connected to the inner portion 48 by a longitudinally extending intermediate portion 54. The intermediate portion 54 is formed by a rounded nose portion having a smoothly curved outer surface 56 with a radius of about 5/16 inch. The nose portion curves downwardly to a U-shaped channel portion 58 having an inclined flat bottom wall from which projects a longitudinally extending tab or flange 62. As shown in FIG. 2, the outer portion 52 of the strip 45 projects outwardly from the channel portion 58, and an outer edge portion curves downwardly to form a drip lip 64 spaced outwardly from the outer edge portion 18 of the gutter 10. The outer portion 52 has a wall thickness generally the same as the inner portion 48, such as 0.030 to 0.040 inch, and preferably, each of the inner and outer portions is resiliently flexible. As best shown in FIG. 3, the connecting intermediate portion 54 of each cover strip 45 may have a heavier wall thickness, for example, on the order of 0.060 to 0.065 inch to provide this portion with more rigidity.

A series of longitudinally spaced slots 68 are formed within the bottom wall of the channel portion 58 below the rounded nose surface 56. The slots have a predetermined length, for example, of three to four inches, and adjacent slots are spaced apart by a predetermined distance, for example, about 1.5 inches so that the inner portion 48 is integrally connected to the outer portion 52 by longitudinally spaced connecting tabs located adjacent opposite ends of the channel portion 58 of each cover section and between the slots 68 With each tab having a length, for example, of about 1.5 inches. The side walls of the U-shaped channel portion 58 define a groove or gap 70 having a predetermined width, for example, between 1/8 inch and 1/4 inch, as shown in FIG. 3. As apparent from FIGS. 2 and 3, the centerline for the rounded outer nose surface 56 is spaced above the highest point of the outer portion 52 or where the outer portion 52 connects with the left side wall of the channel portion 58.

Preferably, the slots 68 are punched, for example, by simultaneously punching a series of longitudinally spaced slots 68 with corresponding punches and a die which confines the channel portion 58 during the punching operation. It is also possible to punch the holes 68 on a successive basis with a rotary wheel-like punch (not shown) having peripherally spaced punch elements. The rotary punch mates with a slot within a stationary plate or rotary die wheel having a peripherally extending slot or spaced slots and forming a backup for the bottom wall of the channel portion 58.

Figure 4:
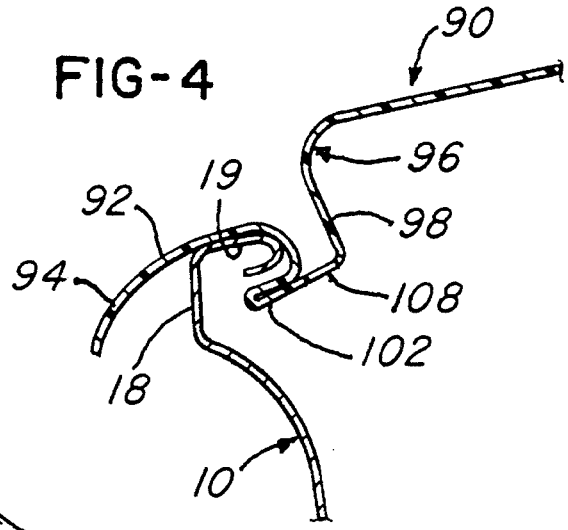
FIG. 4 is a fragmentary section of a cover strip formed in accordance with a modification of the invention.

Referring to FIG. 4, a cover strip 90 is extruded of a semi-rigid plastics material in generally the same manner as the cover strip 45 and includes an outer portion 92 with a drip lip 94 and an intermediate portion 96 having a rounded nose surface, all with the same configuration as the corresponding portions 56 described above in connection with FIGS. 2 and 3. The portions 92 and 96 are integrally connected by a channel portion 98 from which projects a longitudinally extending tab or flange portion 102 having a folded double wall thickness. Preferably, the cover strip 90 is formed from an extruded flat sheet or strip which is formed into the configuration shown in FIG. 4 while the extruded flat strip is still hot. The bottom wall of the channel portion 98 has longitudinally spaced slots 108 which are the same as the slots 68 and are preferably progressively punched while the strip 90 is being formed. These slots 68 or 108 may also be formed by simultaneously punching a group of the slots by a reciprocating punch and die unit which travels with the strip or is used in a secondary operation. When the retaining tab or flange 102 engages a spacer ferrule 38, preferably the flange 102 is notched to form a recess which receives the ferrule.

Figure 5:
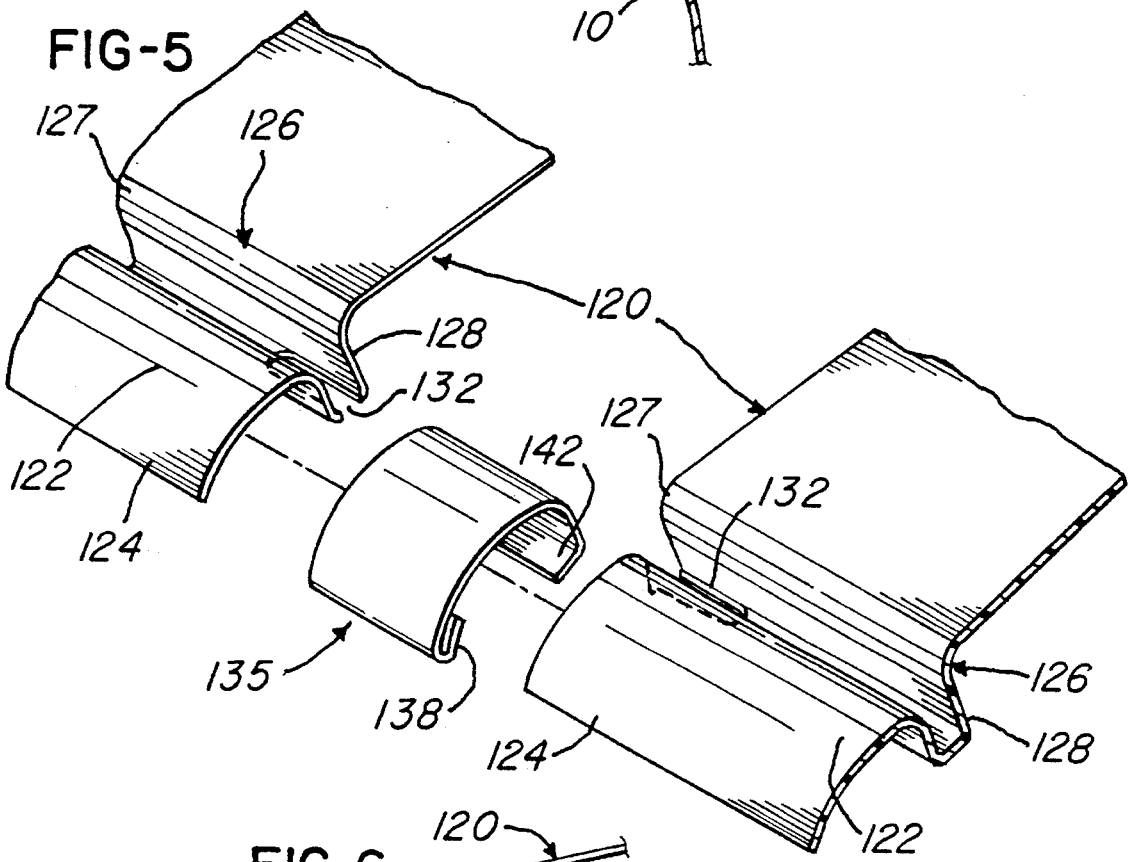
FIG. 5 is an exploded fragmentary perspective view of a cover strip formed in accordance with another modification of the invention.
Figure 6:
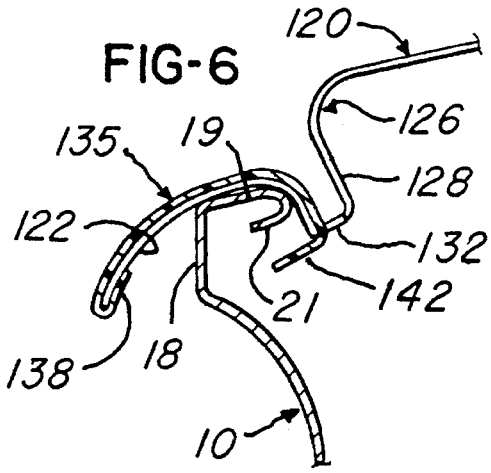
FIG. 6 is a section similar to FIG. 4 of the modification shown in FIG. 5.

Referring to FIGS. 5 and 6, a series of cover strips 120 each have a predetermined length, such as four feet, and are extruded and formed in the same manner as the cover strip 90 except that the retaining tab or flange 102 is omitted. As shown in FIGS. 5 and 6, each cover strip 120 includes an outer portion 122 forming a drip lip 124 and an intermediate portion 126 having a rounded nose surface 127. A channel portion 128 integrally connects the intermediate portion 126 with the outer portion 122, and longitudinally spaced slots 132 are formed within the bottom wall of the channel portion 128 of each cover strip section 120. The cover strips 120 may be easily formed from an extruded flat sheet or strip of plastics material, in the same manner as the cover strip 90 is formed. Also the cover strip 120 may be easily produced by roll-forming a flat aluminum strip fed from a coil in the same manner as the rain gutter 10 is commonly formed.

The cover strips 120 are retained on the gutter 10 by a series of clips 135 which are preferably formed as sections of an extruded flat and formed strip of plastics or vinyl material in the same manner as the cover strips 90 and 120 are formed. The retaining clips 135 have a predetermined length, for example, from one to two inches, and are formed to the contour of the outer portion 122 of the cover strip 120. Each of the retaining clips 135 overlaps the outer portions 122 of a pair of adjacent cover strips 120 and has a U-shaped outer edge portion 138 which receives the drip lips 124 of the cover sections and thereby maintains longitudinal alignment of the outer portions 122 and drip lips 124 of the adjacent cover strips 120. Each retaining clip 135 also includes a retaining tab or flange 142 which projects through opposing shorter slots 132 within the ends of the cover strips 120 and then outwardly under the return flange 19 and tab 21 of the gutter 10. Thus the opposite end portions of each cover strip 120 are attached to the upper front edge portion 18 of the gutter 10 by a pair of end retaining clips 135. The clip 135 may also be used at any place along the length of a cover strip 120 for attaching the cover strip to the gutter 10, simply by flexing or springing a clip 135 and inserting it through one of the slots 132.

From the drawing and the above description, it is apparent that a gutter cover strip or device constructed in accordance with the present invention, provides desirable features and advantages. For example, the gutter cover device or strip 45, 90 or 120 is not only effective to direct water flowing from the roof covering 32 downwardly through the slots 68, 108 or 132 into the rain gutter 10, the cover strip is also effective to deflect leaves, sticks and other debris onto the continuous outer portion 52, 92 or 122 for dropping from the outer edge portion or drip lip 64, 94 or 124. During an unusually heavy thunderstorm, some of the water from the roof may flow over the gap 70 and flow onto the outer portion which deflects the excess water outwardly onto the ground to avoid overflowing of the gutter 10. The cover strip also prevents the build-up of melted snow in the gutter 10 to form an undesirable ice dam which can cause the back-up of water under the roof covering.

The cover device 45 or 90 is also easy to install simply by sliding the inner portion 48 under the shingles 32 and then pulling back outwardly on the drip lip 64 or 94 so that the outer portion 52 or 92 and flange 62 or 102 hook onto the outer edge portion 19 of the gutter 10. The tab or flange 62 or 102 also retains the gutter cover so that the wind does not blow the cover strip upwardly from the gutter. As shown in FIG. 3, the outer portion 52 and tab or flange 62 also provide for tilting or pivoting the cover strip 45 relative to the gutter 10 for accommodating roof pitches of different angles and for accommodating the gradual slope of the gutter 10 relative to the outer edge of the roof covering or shingles 32.

The thinner wall thickness of the inner port ion 48 and outer port ion 52 also permits flexing of these portions for accommodating roof pitches of different angles and to permit a ladder to rest against the outer channel portion 18 of the gutter 10 without damaging the cover device. The heavier wall thickness of the channel portion 58 provides for a groove or gap 70 of uniform width along the entire length of the cover strip 45. The cover strip 45 may also be extruded in different colors, such as white or bronze, or be painted with a latex paint in order to match or be compatible with the color of the rain gutter 10. As shown in FIG. 2, the retaining flange 62 may be quickly cut with shears, if necessary, to form V-shape notches for receiving the spacer tubes 38. The embodiment shown in FIGS. 5 and 6 is also easy to install simply by inserting the clips 135 onto the opposing ends of the outer portions 122 and/or by snapping the clips 135 through the slots 132. In addition, the clips 135 maintain alignment of the drip lips 124 of the cover strips 120.

While the form of rain gutter cover herein described and its method of production constitute a preferred embodiment of the invention, it is to be understood that the invention is not limited to this precise form of cover, and that changes may be made therein without departing from the scope and spirit of the invention as defined in the appended claims. For example, while the cover device 45 is shown in FIGS. 1–3 as a profile extrusion, the cover device may also be formed or shaped from an extruded flat strip of vinyl or similar plastics material as shown in FIGS. 4–6. The flange 102 would then have a folded double wall thickness. The portions of the flat strip forming the inner portion 48 and drip lip 64, 94 or 128 may be extruded with a reduced thickness to provide the portions with more flexibility.

The invention having thus been described, the following is claimed:

1. In combination with an elongated rain gutter defining an open top trough and including an outer front wall with an upper edge portion projecting into the trough, a device for deflecting leaves and other debris over the gutter onto the ground and for directing water draining from a roof covering into the gutter, said device comprising an elongated cover strip including a longitudinally extending inner portion adapted to project under the roof covering, said inner portion continuing outwardly to cover a substantial portion of said gutter and to direct substantially all of the water received from the roof covering over said substantial portion of said gutter, said strip also including a longitudinally extending outer portion positioned to seat on the upper edge portion of the gutter, a longitudinally extending intermediate portion integrally connecting said inner and outer portions of said strip adjacent said upper edge portion of said gutter, said intermediate portion including a longitudinally extending nose portion disposed above said outer portion of said strip, said intermediate portion further including means defining longitudinally spaced openings disposed below said nose portion, said nose portion being effective to direct water received from said inner portion of said strip downwardly through said openings into the gutter and for deflecting leaves and other debris outwardly onto said outer portion of said strip, and a longitudinally extending flange projecting from said intermediate portion under said outer portion of said strip and cooperating with said outer portion of said strip to define a channel for receiving said upper edge portion of said gutter.

2. The combination as defined in claim 1 where in said outer portion of said strip and said flange define therebetween a space substantially greater than the thickness of said upper edge portion to provide for pivoting said cover strip on said upper edge portion of said gutter.

3. The combination as defined in claim 1 wherein said outer portion of said strip projects outwardly from said upper edge portion of said gutter and forms a lip portion spaced outwardly from said front wall of said gutter.

4. The combination as defined in claim 1 wherein said flange comprises a folded longitudinally extending flange portion having generally a double wall thickness.

5. In combination with an elongated rain gutter defining an open top trough and including an outer front wall with an upper edge portion projecting into the trough, a device for deflecting leaves and other debris over the gutter onto the ground and for directing water draining from a roof covering into the gutter, said device comprising an elongated cover strip formed by a linear section of a one-piece extrusion of semi-rigid plastics material, said strip including a longitudinally extending inner portion adapted to project under the roof covering, said inner portion continuing outwardly to cover a substantial portion of said gutter and to direct substantially all of the water received from the roof covering over said substantial portion of said gutter, said strip also including a longitudinally extending outer portion positioned to seat on the upper edge portion of the gutter, a longitudinally extending intermediate portion integrally connecting said inner and outer portions of said strip adjacent said upper edge portion of said gutter, said intermediate portion including a longitudinally extending nose portion disposed above said outer portion of said strip, said intermediate portion further including means defining longitudinally spaced openings disposed below said nose portion, said nose portion being effective to direct water received from said inner portion of said strip downwardly through said openings into the gutter and for deflecting leaves and other debris outwardly onto said outer portion of said strip, and flange means projecting from said intermediate portion under said outer portion of said strip and cooperating with said outer portion of said strip to define a channel for receiving said upper edge portion of said gutter.

6. In combination with an elongated rain gutter defining an open top trough and including an outer front wall with an upper edge portion projecting into the trough, a device for deflecting leaves and other debris over the gutter onto the ground and for directing water draining from a roof covering into the gutter, said device comprising an elongated cover strip including a longitudinally extending inner portion adapted to project under the roof covering, said inner portion continuing outwardly to cover a substantial portion of said gutter and to direct substantially all of the water received from the roof covering over said substantial portion of said gutter, said strip also including a longitudinally extending outer portion positioned to seat on the upper edge portion of the gutter, a longitudinally extending intermediate portion integrally connecting said inner and outer portions of said strip adjacent said upper edge portion of said gutter, said intermediate portion including a longitudinally extending nose portion disposed above said outer portion of said strip, said intermediate portion further including a U-shaped channel portion projecting downwardly from said nose portion and below said upper edge portion of said gutter, said channel portion having a bottom wall defining longitudinally spaced openings, said nose portion being effective to direct water received from said inner portion of said strip downwardly through said openings into the gutter and for deflecting leaves and other debris outwardly onto said outer portion of said strip, and flange means projecting from said intermediate portion under said outer portion of said strip and cooperating with said outer portion of said strip to define a channel for receiving said upper edge portion of said gutter.

* * * * *